US011154121B2

(12) United States Patent
Weil

(10) Patent No.: US 11,154,121 B2
(45) Date of Patent: Oct. 26, 2021

(54) DUAL FASTENING EARRINGS

(71) Applicant: Abraham Weil, Lakewood, NJ (US)

(72) Inventor: Abraham Weil, Lakewood, NJ (US)

( * ) Notice: Subject to any disclaimer, the term of this patent is extended or adjusted under 35 U.S.C. 154(b) by 2 days.

(21) Appl. No.: 16/808,293

(22) Filed: Mar. 3, 2020

(65) Prior Publication Data

US 2021/0274894 A1 Sep. 9, 2021

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/00; A44C 7/001; A44C 7/002; Y10T 24/41
See application file for complete search history.

(56) References Cited

U.S. PATENT DOCUMENTS 625,890 A * 5/1899 Mann ..... A44C 7/003 24/705
958,404 A * 5/1910 Jameson ..... A44B 9/10 24/706.9
982,727 A * 1/1911 Jones ..... A44B 9/10 24/706.9
986,874 A * 3/1911 Thomlinson ..... A44B 9/10 24/706.9
1,073,360 A * 9/1913 Morgan ..... A44B 9/10 24/706.6
4,299,101 A * 11/1981 Block ..... A44C 7/003 411/527
5,893,278 A * 4/1999 Float ..... A44C 7/003 63/12

* cited by examiner

*Primary Examiner* — Jack W Lavinder

(57) ABSTRACT

Earrings, featuring a dual fastening mechanism combining threading with a ring of receiving substance.

20 Claims, 2 Drawing Sheets

DUAL FASTENING EARRINGS

BACKGROUND

The value of jewelry lies in the materials, and since the material may include any combination of gold, silver, and precious gems, including diamonds, the monetary value of the material alone can be very high. Because of the value of the material, the jewelry is often shaped by an expert jeweler, whose services command high prices, thus further increasing the value of the finished product.

Despite the care taken by their owners, many expensive pieces jewelry, and earrings in particular, are often lost. This is at least in part due to the failure of the current ways in which earrings clasp onto the ear. This failure is the result of the basic inadequacy of the securement mechanism, where the securement mechanism is simply not secure, and the limitation imposed on that mechanism, which demands that the earring be easily attached and detached. Wearers are often checking and double-checking their earrings to make sure they have not fallen out, which is a constant source of anxiety. Also, wearers often refrain from activities that they would normally feel comfortable engaging it, were it not for their earrings. For example, many kinds of physical activity involve fast motions, reorienting the body, or the head, upside down or side to side, which results in unexpected forces applied to the earrings, increasing the likelihood that they will detach from the ear. While this is true for most forms of athletics, it is also true for basic actions, such as bending over to pick up an object, or reaching up to grab something from a shelf. These basic actions also result in the earrings being jostled around. Because of the ease with which earrings are lost, many people eschew such forms of ornamentation altogether. Parents often forgo ear piercings for their children because children tend to be more physically active and less careful than adults, and the parents themselves may also avoid earrings themselves since they often have to chase after their children.

Screw-back earrings were developed to solve the problems described above, but they are far from perfect. Principally, the internal and/or external threading must be relatively loose in order for the screw-backs to be easily engaged or unengaged. But because of the low-level of friction between the threads, the screw-back and earring are often rotated with respective to one another in the course of regular daily activities. This loosening occurs by virtue of vibrations, which the earring is subject to even in the complete absence of the jostling motions described previously. Because ears often hang from the earlobe, even if the wearer is sitting in a chair and working at a computer, the mere movements involved in typing cause sufficient vibrations to unscrew the screw-backs. One solution that is used is to lengthen the screw shaft; however, this merely delays the point at which the earrings fall out, but does not address the underlying problem. Another solution is to add glue to the external threading on the screw shaft. While this does provide the extra friction needed, the screw ridges cut into the glue, thus destroying its friction-provision over time. A third solution is to add a spring-clamp locking mechanism, but such mechanisms are an added expense, can be easily unlocked by accident upon being pressed against the neck or another surface, such as headphones, and are difficult to operate intentionally without the use of a mirror or much practice.

What is needed is a way to provide a friction-fit earring-back attachment mechanism that does not lose its friction-provision over time, is easy to attach and detach, does not require too many components, and can be manipulated easily by the wearer.

SUMMARY

The dual fastening earring features an ornament attached to a shaft. The shaft may be threaded on one end to engage with a threads in a cap. The cap may feature an internal silicon or rubber ring in order to grip the shaft as it enters the cap cavity and before it engages with the cap threads.

DETAILED DESCRIPTION

Figure 1:
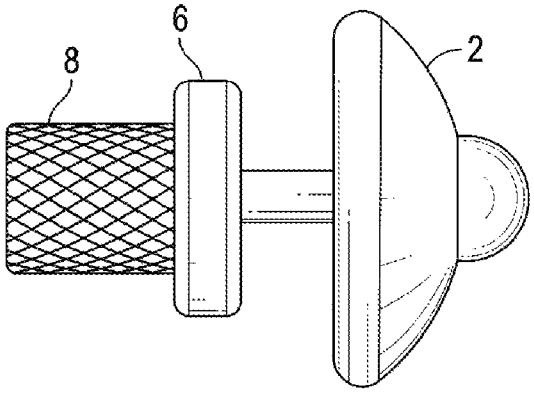
FIG. 1-2 show external views of exemplary dual fastening earrings.
Figure 2:
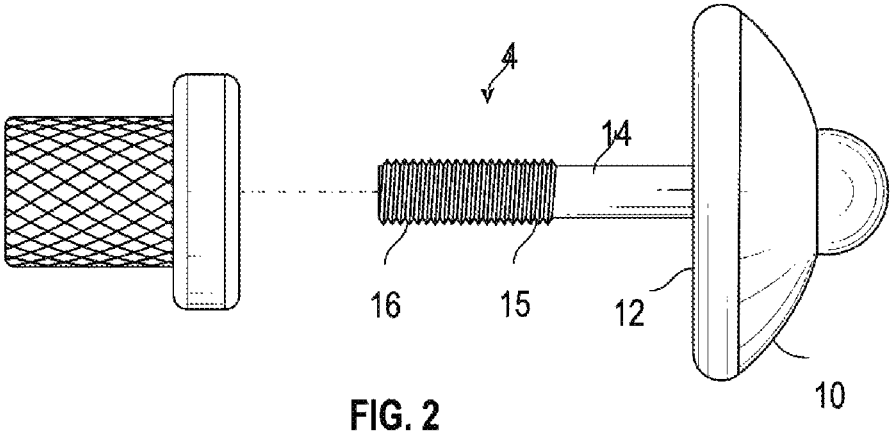
Figure 3:
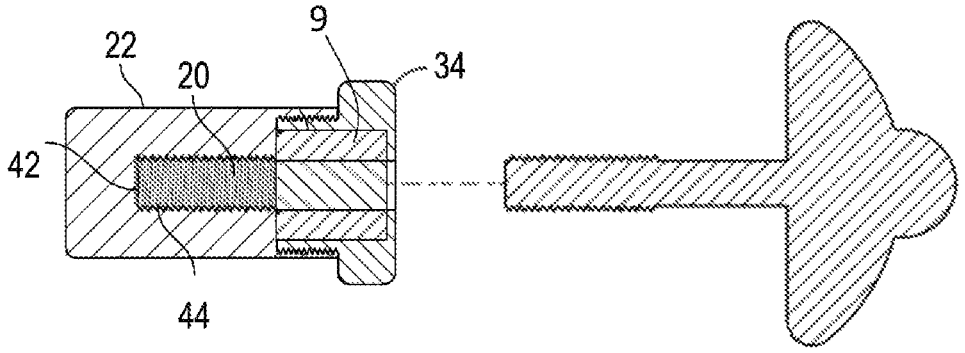
FIGS. 3-4 show section views of exemplary dual fastening earrings.
Figure 4:
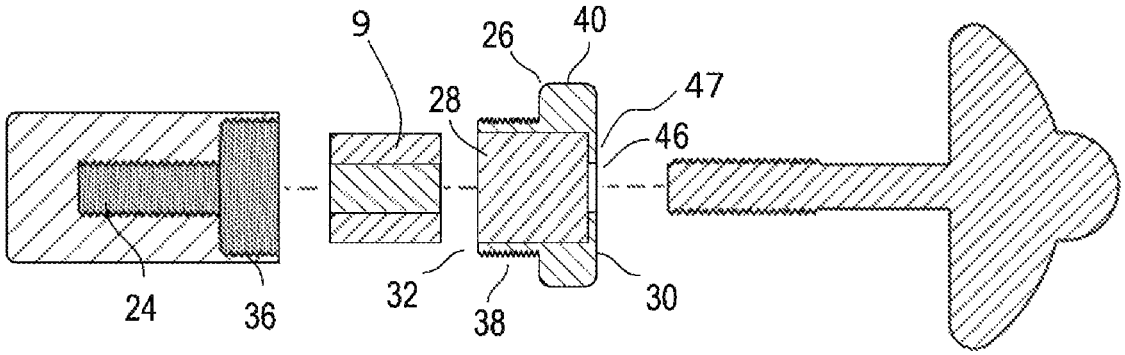

As shown in FIGS. 1-4, the Dual Fastening Earrings comprise an ornament 2, a shaft 4, a disc 6, a cap 8, and a receiving ring 9. The ornament comprises a front side 10 and a back side 12, with the front side principally containing, carrying, framing or otherwise expressing the ornamental aspect. It may be in the shape of any conceivable ornamental shape, including a stud, and may be embedded with one or more jewels, artificial and/or natural.

The receiving substance may form a ring of an inside diameter slightly smaller than the outer diameter of the shaft, so that in order for the shaft to be pressed through the ring, the friction of the shaft against the receiving substance must be overcome, and also, sufficient force must be used to compress the ring outward, so that the inside diameter of the ring approaches the outside diameter of the ring, thereby providing enough space for the shaft to push through. As a result of these forces, the ring of the receiving substance will exert itself against the shaft in order to maintain and return to its original shape and configuration, thereby causing the shaft to be held in place even before it is threadedly engaged with the cap.

The shaft comprises a first end 14 and a second end 16, with a middle portion 15 continuous between the first end and the second end. The first end is attached to the ornament. The attachment may be by welding, unified mold formation, or by any other om intended for permanent fixation. The second end is attachable to the cap.

The cap may feature an internal section 20, configured to receive the disc and/or shaft, and an external section 22, configured to be gripped by the user, and may feature one or more ornamental elements.

The internal section of the cap may feature a deep cavity 24 configured to receive the second end of the shaft. The deep cavity is shaped substantially like the second end of the shaft in order to provide a tighter fit. The deep cavity may engage with the second end of the shaft via threading and/or a receiving substance.

The receiving substance may be configured to permit the shaft to penetrate it or withdraw from it, with both the penetration and the withdrawal requiring the overcoming of a threshold force in order to prevent the accidental actions thereof. It may be rough, self-healing, and/or elastic. The receiving material may be made of silicon, rubber, or other materials possessing similar characteristics. In one embodiment, the receiving substance may be disposed at the tip of the deep cavity 42 or its cylindric inner surface 44.

The disc may comprise an external side 26 and an internal side 28, with the internal side being inside the external side. The internal side and external side each feature an ornament-facing side 30 and a cap-facing side 32, with the ornament-facing side being primarily exposed to the back side of the ornament and the cap-facing side being primarily exposed to the cap.

The external side of the disc is configured to be easily gripped by the fingers, and may be substantially circular or any shape designed to be appear elegant. The external side may have one or more surface portions 34, with the different surface portions having a common or dissimilar texture, such as smooth or rough. The external side may also circumference varying diameters, such as having a smaller diameter section 38 and a larger diameter section 40.

The internal side of the disc is configured to receive the second end of the shaft, permit the shaft to pass through the ornament-facing and cap-facing sides. Accordingly, it is substantially inversely cylindrical. In one variation, the internal side engages with the shaft via threading, with male threading disposed on the shaft and/or female threading disposed on the internal side of the disc. In another variation, the internal side engages with the shaft via a friction-fit texture, with a rough texture being disposed on the shaft and/or the internal side of the disc. The rough texture may be ridges or similar projections protruding from the shaft and/or the internal side, or it may comprise a rough material adhered or otherwise surrounding a shaft circumference section and/or the internal side. In a preferred embodiment, the ring of receiving material 9 described previously may be disposed on the internal side to secure a snug fit between the disc and the shaft. The ornament-facing side may feature a disc opening or mouth 46, which has a diameter smaller than the internal side of the disc. The mouth wall 47, which is also featured on the ornament-facing side and surrounds the mouth, is configured to permit the shaft to pass through but not permit the ring or receiving material to be dragged out when the shaft is withdrawn.

The internal section of the cap may feature a shallow cavity 36 configured to receive the smaller diameter section of the disc. The smaller diameter section and the shallow cavity may engage via threading, or they may be permanently connected by glue, thermoforming, a unifying mold, or other methods. The smaller diameter section of the disc is accordingly small enough in diameter to enter the shallow cavity but is otherwise blocked from emptying the deep end, which is sufficiently wide enough to receive the shaft but not the smaller diameter section.

The disc length may be sufficient to enable the receiving material to engage with the shaft before the shaft engages with a threaded portion of the cap, so that a "snug-fit" phenomenon facilitates the subsequent engagement between the shaft and disc threads and impedes the shaft from being accidental removing prior to said engagement.

In one embodiment, the disc is permanently attached to and forms a part of the cap. In this embodiment, the cap comprises the internal and external sides of the disc and the ornament-facing side. As such, the ring of receiving material is embedded inside the shallow cavity of the cap.

The invention claimed is:

1. Dual fastening earrings comprising an ornament, a shaft, a disc, a cap, and a ring of receiving substance;

a. the ornament comprising a front side and a back side;

b. the shaft comprising a first end, a second end, and a middle portion, the first end attached to the back side of the ornament, the second end having male threading, the first and the middle portions not having threading;

c. the disc comprising an external side and an internal side, both the external side and the internal side comprising an ornament-facing side and a cap-facing side, the external side having a smaller diameter section and a larger diameter section, the internal side having configured to receive and the second end of the shaft, the ornament-facing side comprising a mouth configured to receive the shaft, the smaller diameter section of the external side having male threading for engaging with the cap, the larger diameter section configured to be gripped by a user and;

d. the cap comprising an internal section and an external section, the external section configured to be gripped by the user, the Internal section configured to receive the disc and shaft and comprising a deep cavity and a shallow cavity, the deep cavity having female threading and configured to receive and threadably engage with the second end of the shaft, and the shallow cavity having female threading configured to receive and threadably engage the smaller diameter section of the disc;

e. the ring of receiving substance being made of silicon, rubber, or other elastic material, and disposed on the internal side of the disc and/or the internal section of the cap and configured to grip the second end of the shaft before the second end of the shaft enters the deep cavity;

f. the ring of receiving substance having an outer diameter larger than a diameter of the mouth.

2. Dual fastening earrings comprising an ornament, a shaft, a cap, and a ring of receiving substance;

a. the ornament comprising a front side and a back side;

b. the shaft comprising a first end, a second end, and a middle portion;

c. the cap comprising an internal section and an external section, the external section configured to be gripped by the user, the internal section configured to receive the shaft and comprising a deep cavity, the deep cavity configured to receive the second end of the shaft;

d. the ring of receiving substance disposed inside the cap and configured to grip the second end of the shaft as the shaft enters the ring of receiving substance, e. the ring of receiving substance being made of silicon, rubber, or other elastic material, f. the shaft configured to threadably engage with the cap.

3. The dual fastening earrings of claim 2, additionally comprising a disc, the disc comprising an external side and an internal side, both the external side and the internal side comprising an ornament-facing side and a cap-facing side, the internal side configured to receive the second end of the shaft.

4. The dual fastening earrings of claim 3, the external side of the disc having a smaller diameter section and a larger diameter section, the larger diameter section configured to be gripped by a user and the smaller diameter section configured to engage with and connect to the cap.

5. The dual fastening earrings of claim 4, the cap additionally comprising a shallow cavity, the shallow cavity configured to receive the smaller diameter section of the disc.

6. The dual fastening earrings of claim 4, the smaller diameter section of the external side having male threading configured to engage with female threading on the internal section of the cap.

7. The dual fastening earrings of claim 3, the internal side of the disc having female threading and configured to receive and threadably engage the second end of the shaft.

8. The dual fastening earrings of claim 3, the ring of receiving substance disposed on the Internal side of the disc.

9. The dual fastening earrings of claim 2, the ring of receiving substance made of silicon, rubber, or other elastic material.

10. The dual fastening earrings of claim 2, the ring of receiving substance disposed on the internal section of the cap.

11. The dual fastening earrings of claim 2, the ring of receiving substance configured to grip the second end of the shaft after entering the cap but before entering the deep cavity.

12. The dual fastening earrings of claim 2, the second end of the shaft having male threading.

13. The dual fastening earrings of claim 2, the first and middle portion of the shaft not having threading.

14. The dual fastening earrings of claim 2, the ring of receiving substance being disposed on the internal section of the cap and configured to grip the second end of the shaft before the second end of the shaft enters the deep cavity.

15. The dual fastening earrings of claim 14, the ring of receiving substance being made of silicon, rubber, or other elastic material.

16. Dual fastening earrings comprising an ornament, a shaft, a cap, a disc, and a receiving substance;

a. the ornament comprising a front side and a back side;

b. the shaft comprising a first end, a second end, and a middle portion;

c. the cap comprising an internal section and an external section, the external section configured to be gripped by the user, the internal section configured to receive the shaft and comprising a deep cavity, the deep cavity having an innermost point and configured to receive the second end of the shaft;

d. the disc connected to the cap and having a mouth wall, a mouth, an external side and an internal side, the Internal side configured to receive the second end of the shaft through the mouth, the mouth wall surrounding the mouth;

e. the receiving substance disposed in the deep cavity and configured to grip the second end of the shaft.

17. The dual fastening earrings of claim 16, the receiving substance formed into a ring, disposed on the internal side of the disc, having a diameter larger than the mouth, and configured to grip the second end of the shaft before the shaft enters the deep cavity; and the mouth wall configured to prevent the ring of receiving substance from being pulled out of the disc when the shaft is withdrawn.

18. The dual fastening earrings of claim 17, the receiving substance also positioned at the innermost point of the deep cavity and configured to grip the second end of the shaft after the shaft passes through the internal side of the disc.

19. The dual fastening earrings of claim 16, the receiving substance positioned at the innermost point of the deep cavity and configured to grip the second end of the shaft after the shaft passes through the internal side of the disc.

20. The dual fastening earrings of claim 19, the deep cavity having female threads and the shaft having male threads configured to engage with the deep cavity female threads.

* * * * *